US011319657B2

(12) United States Patent
Kim

(10) Patent No.: US 11,319,657 B2
(45) Date of Patent: May 3, 2022

(54) WASHING APPARATUS AND CONTROLLING METHOD THEREOF

(71) Applicant: Samsung Electronics Co., Ltd., Suwon-si (KR)

(72) Inventor: Seung-Hoon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 77 days.

(21) Appl. No.: 16/698,584

(22) Filed: Nov. 27, 2019

(65) Prior Publication Data

US 2020/0173094 A1 Jun. 4, 2020

(30) Foreign Application Priority Data

Nov. 29, 2018 (KR) ..... 10-2018-0150285

(51) Int. Cl.

| | |
|---|---|
| ***D06F 39/04*** | (2006.01) |
| ***D06F 34/22*** | (2020.01) |
| ***D06F 34/28*** | (2020.01) |
| ***D06F 33/00*** | (2020.01) |
| *D06F 103/16* | (2020.01) |
| *D06F 103/46* | (2020.01) |
| *D06F 101/00* | (2020.01) |

(52) U.S. Cl.

CPC ..... *D06F 39/04* (2013.01); *D06F 33/00* (2013.01); *D06F 34/22* (2020.02); *D06F 34/28* (2020.02); *D06F 2101/00* (2020.02); *D06F 2103/16* (2020.02); *D06F 2103/46* (2020.02)

(58) Field of Classification Search

None

See application file for complete search history.

(56) References Cited

U.S. PATENT DOCUMENTS

| | | | | |
|---|---|---|---|---|
| 9,416,476 | B2 | 8/2016 | Wong | |
| 2011/0099732 | A1 | 5/2011 | Im et al. | |
| 2012/0193985 | A1* | 8/2012 | Kim | D06F 33/46 307/35 |
| 2018/0258576 | A1* | 9/2018 | Kim | D06F 34/22 |
| 2018/0313014 | A1* | 11/2018 | Kim | D06F 33/00 |

FOREIGN PATENT DOCUMENTS

| | | | |
|---|---|---|---|
| EP | 3299504 | A1 | 3/2018 |
| JP | 2006-204714 | A | 8/2006 |
| KR | 10-1218031 | B1 | 1/2013 |

OTHER PUBLICATIONS

European Search Report in connection with European Application No. 19212158.0 dated Mar. 13, 2020, 8 pages.

Communication pursuant to Article 94(3) EPC dated Dec. 23, 2020 in connection with European Patent Application No. 19 212 158.0, 4 pages.

* cited by examiner

*Primary Examiner* — Cristi J Tate-Sims

(57) ABSTRACT

A washing machine including a tub configured to store water; a drum configured to be rotatable in the tub; a motor configured to rotate the drum; heaters configured to heat the water stored in the tub and including a main heater and the sub heater; and a controller configured to control the heaters to stop driving of the sub heater when the current value of the motor exceeds a predetermined reference current value during driving of the motor and the heaters.

17 Claims, 7 Drawing Sheets

WASHING APPARATUS AND CONTROLLING METHOD THEREOF

CROSS-REFERENCE TO RELATED APPLICATION

This application is based on and claims priority under 35 U.S.C. § 119 to Korean Patent Application No. 10-2018-0150285, filed on Nov. 29, 2018 in the Korean Intellectual Property Office, the disclosure of which is incorporated by reference in its entirety.

BACKGROUND

1. Field

The disclosure relates to a washing machine including a main heater and a sub heater for heating water in a tub, and a method of controlling the washing machine.

2. Description of Related Art

Generally, washing machines are devices for doing laundry by rotating its cylindrical spinning tub that contains laundry. As for types of the washing machine, there are washing machines in which a drum is horizontally positioned to do the laundry by raising and dropping the laundry along an inner wall of the drum while rotating around a horizontal axis, and washing machines in which a drum having a pulsator therein is vertically positioned to do the laundry using water currents produced by the pulsator while the drum is rotating around a vertical axis.

The washing machine in which the drum is horizontally positioned is called a front loading washing machine because a laundry inlet is formed on the front, and the washing machine in which the drum is vertically positioned is called a top loading washing machine because the laundry inlet is formed on the top.

Typical washing machines employ one of the two types to do the laundry. In addition, to take advantage of both of the above-described types, washing machines including a plurality of washing devices driven by different types have also appeared.

SUMMARY

Therefore, it is an aspect of the disclosure to provide a washing machine capable of preventing an overcurrent from flowing into the washing machine by controlling the driving of a sub heater according to a current value of a motor when the motor and heaters are driven at the same time, and a method of controlling the washing machine.

Additional aspects of the disclosure will be set forth in part in the description which follows and, in part, will be obvious from the description, or may be learned by practice of the disclosure.

In accordance with an aspect of the disclosure, a washing machine includes a tub configured to store water; a drum configured to be rotatable in the tub; a motor configured to rotate the drum; heaters configured to heat the water stored in the tub and including a main heater and a sub heater; and a controller configured to control the heaters to stop driving of the sub heater when a current value of the motor exceeds a predetermined reference current value during driving of the motor and the heaters.

The main heater may be configured to have a larger power consumption than the power consumption of the sub heater.

The controller may be configured to drive the sub heater again when the current value of the motor becomes smaller than the predetermined reference current value after the driving of the sub heater is stopped.

The controller may be configured to drive the sub heater again when a temperature of the water in the tub is lower than a target temperature.

The washing may further include a control panel configured to provide a washing mode selection menu. The controller may be configured to control the driving of each of the motor, the main heater, and the sub heater according to a washing mode input through the control panel.

The controller may be configured to independently control the main heater and the sub heater.

The controller may be configured to obtain the current value of the motor in real time.

In accordance with another aspect of the disclosure, a method of controlling a washing machine includes driving a motor configured to rotate a drum provided in a tub; driving, by a controller, heaters including a main heater and a sub heater so that a temperature of water stored in the tub reaches a target temperature; obtaining, by the controller, a current value of the motor; and controlling, by the controller, the heaters to stop the driving of the sub heater when the current value of the motor exceeds a predetermined reference current value during the driving of the motor and the heaters.

The main heater may be configured to have a larger power consumption than the power consumption of the sub heater.

The controlling of the heaters may include driving the sub heater again when the current value of the motor becomes smaller than the predetermined reference current value after the driving of the sub heater is stopped.

The controlling of the heaters may include driving the sub heater again when the temperature of the water in the tub is lower than the target temperature.

The controlling of the heaters may include independently controlling the main heater and the sub heater.

The obtaining of the current value of the motor may include obtaining the current value of the motor in real time.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
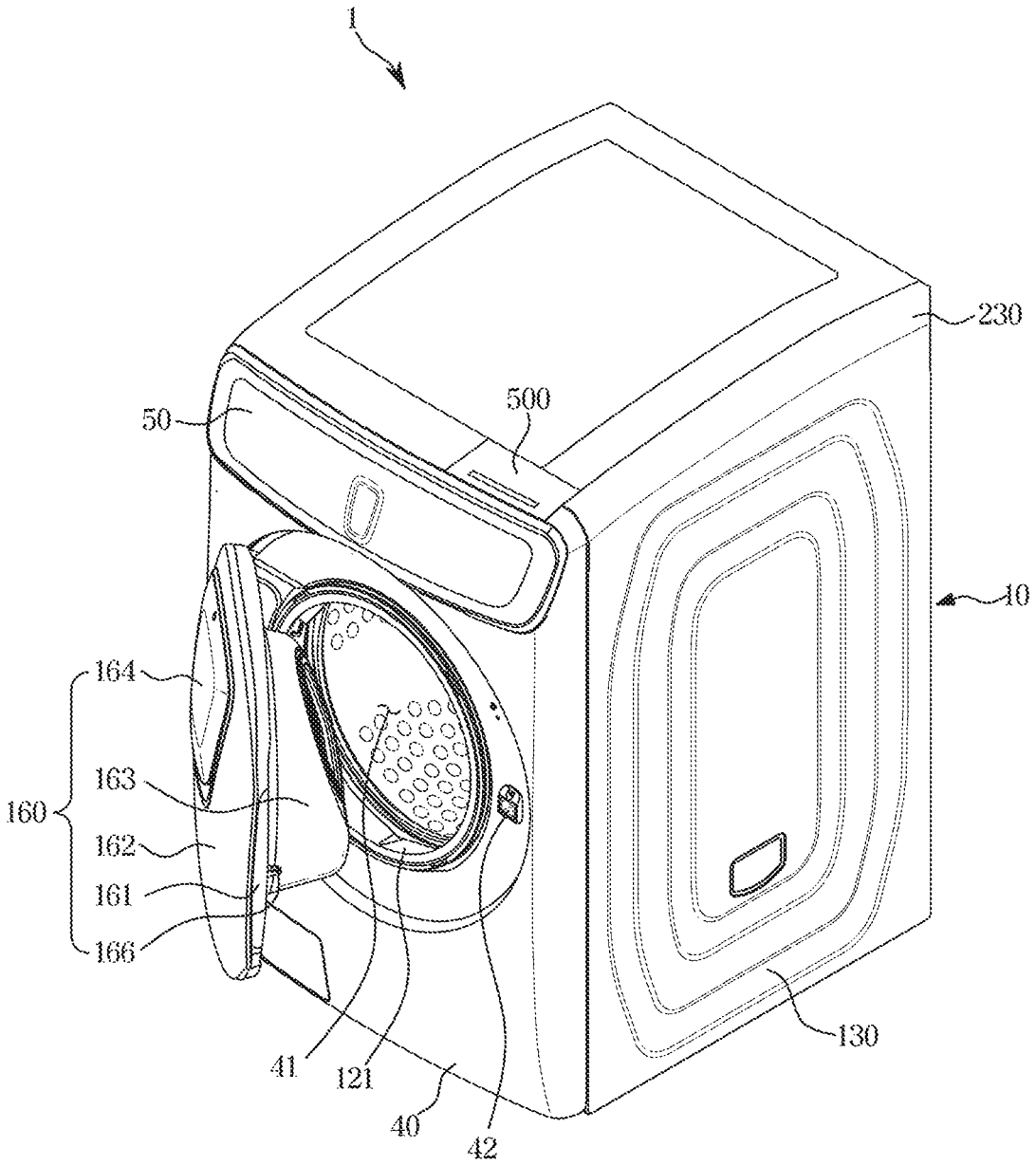
FIG. 1 illustrates a perspective view of a washing machine according to embodiments of the disclosure.

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described herein and configurations illustrated in the accompanying drawings are only certain examples of the disclosure. Various modifications may be made at the time of filing of the present application to replace the embodiments and drawings of the present specification. The terms used herein are intended to only describe certain embodiments. The terms shall by no means restrict and/or limit the disclosure.

The terms as used throughout the specification, such as "~part," "~module," "~member," "~block." etc., may be implemented in software and/or hardware, and a plurality of "~parts," "~modules," "~members," or "~blocks" may be implemented in a single element, or a single "~part," "~module," "~member," or "~block" may include a plurality of elements. It is to be understood that the singular forms "a," "an," and "the" include plural referents unless the context clearly dictates otherwise. Also, it will be understood that, although the terms first, second, third, etc., may be used herein to describe various elements, it should not be limited by these terms. These terms are only used to distinguish one element from another element.

In addition, the terms such as "comprising," "having" or "including" are intended to designate the presence of characteristics, numbers, steps, operations, elements, parts or combinations thereof, and shall not be construed to preclude any possibility of the presence or addition of one or more other characteristics, numbers, steps, operations, elements, parts or combinations thereof.

As used herein, the terms "portion," "unit," "block," "member," or "module" refer to a unit that can perform at least one function or operation. For example, these terms may refer to at least one piece of software stored in a memory or at least one piece of hardware, such as a Field Programmable Gate Array (FPGA) or an Application Specific Integrated Circuit (ASIC), or at least one process that is processed by a processor.

Hereinafter, embodiments of the disclosure will be described in detail with reference to the accompanying drawings. In the drawings, the same reference numerals or signs given may refer to parts or components that perform substantially the same function.

Figure 2:
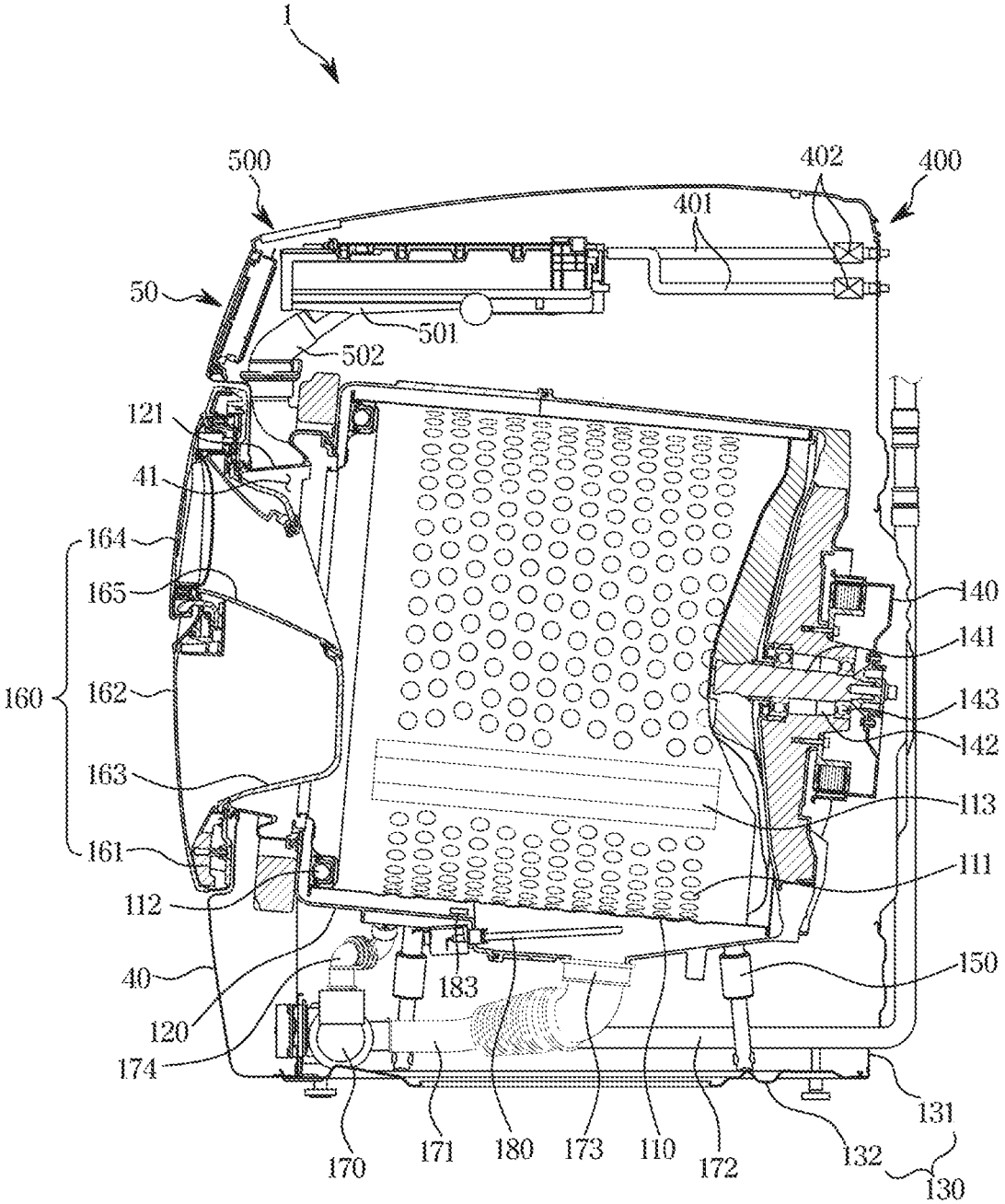
FIG. 2 illustrates a cross-sectional view of the washing machine illustrated in FIG. 1.
Figure 3:
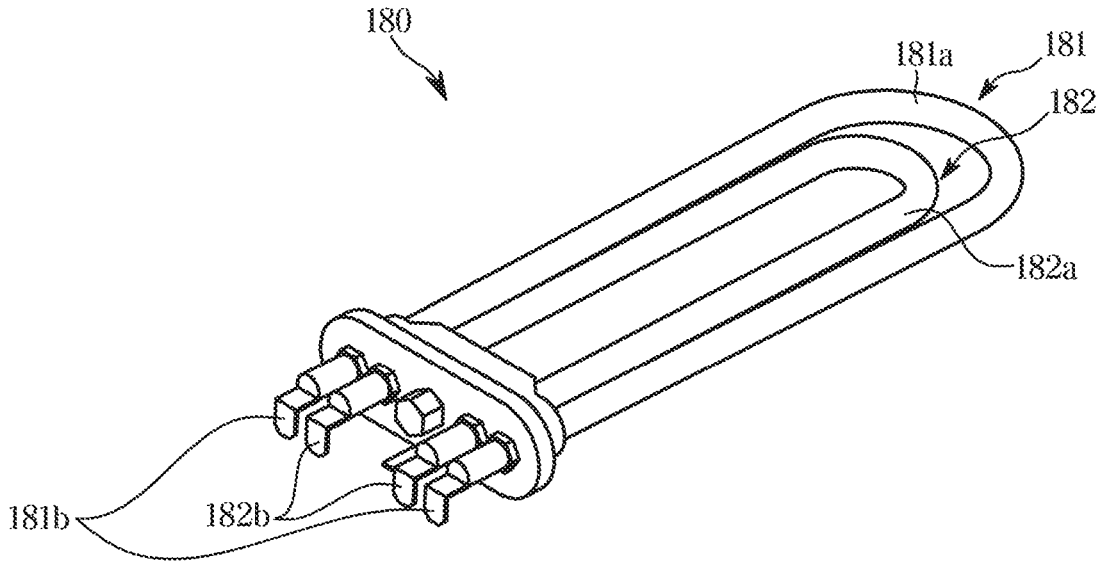
FIG. 3 illustrates a perspective view of a heater of a washing machine according to embodiments of the disclosure.
Figure 4:
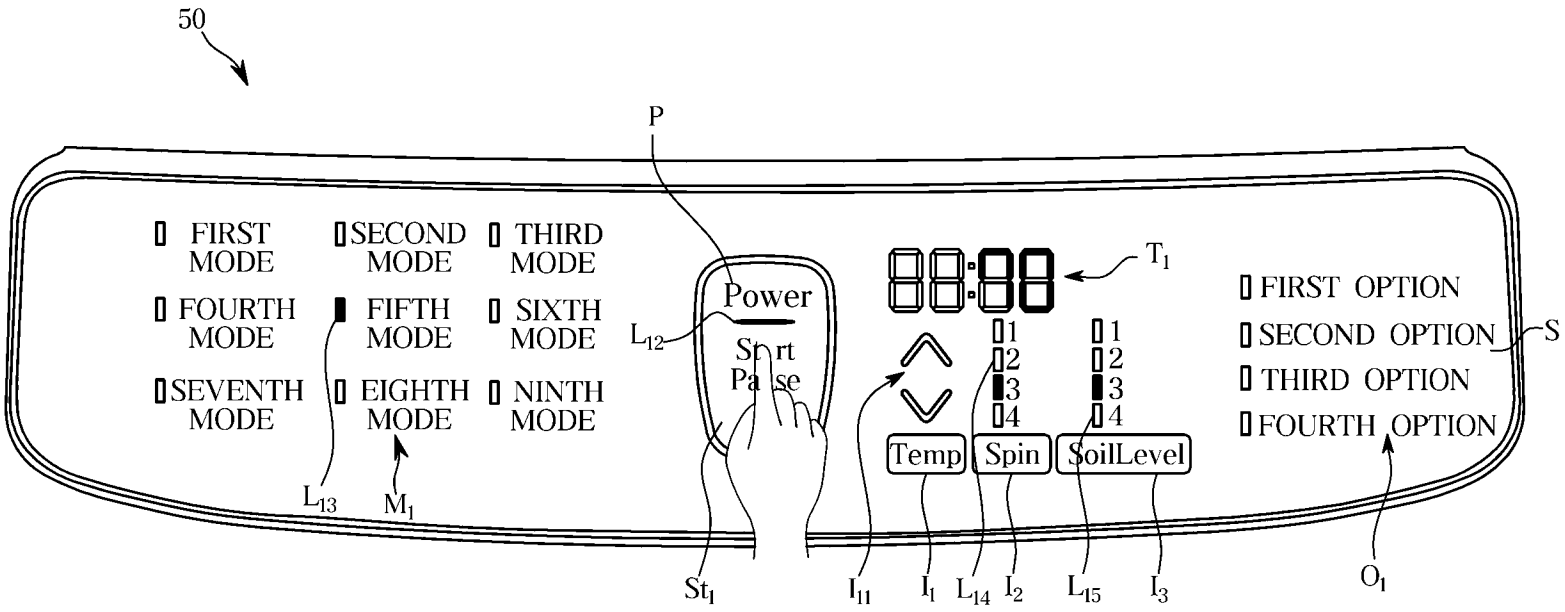
FIG. 4 is a view illustrating a control panel of a washing machine according to embodiments of the disclosure.

FIG. 1 illustrates a perspective view of a washing machine according to embodiments of the disclosure, FIG. 2 illustrates a cross-sectional view of the washing machine illustrated in FIG. 1, FIG. 3 illustrates a perspective view of a heater of a washing machine according to embodiments of the disclosure, and FIG. 4 is a view illustrating a control panel of a washing machine according to embodiments of the disclosure.

Referring to FIGS. 1 and 2, a washing machine 1 may include a drum 110 in which a washing space is formed and a tub 120 containing the drum 110 and storing water (washing water or rinsing water) to be used in a washing course or a rinsing course. The drum 110 and the tub 120 may be provided in a cylindrical shape with at least a portion of a side opened, and the open portion may be disposed almost toward the front.

In addition, the washing machine 1 may include a housing 130. In detail, the housing 130 may include a side frame 131 forming lateral and rear sides and a bottom frame 132 forming a bottom surface.

The washing machine 1 may include a damper 150 capable of supporting the tub 120 in the housing 130. The damper 150 may connect an outer surface of the tub 120 and the bottom frame 132 to support the tub 120 below. The damper 150 may serve to mitigate vibration, noise, and shock generated by the flow of the tub 120.

An installation position of the damper 150 is not limited to an upper end of the side frame 131 and the bottom frame 132, and may support the tub 120 by connecting a side of the tub 120 and a portion of the housing 130 as necessary.

The washing machine 1 may include a motor 140 disposed at the rear of the tub 120 to rotate the drum 110. A driving shaft 141 may be connected to the rear side of the drum 110 configured to transmit power from the motor 140. A plurality of holes 111 may be formed along the circumference of the drum 110 for the flow of water. A plurality of lifters 113 may be installed on an inner circumferential surface of the drum 110 to enable laundry to be moved up and down while the drum 110 is rotating. A balancer 112 may be equipped on the front of the drum 110 to help the drum 110 stably spin at high speed.

The driving shaft 141 may be coupled to a rear plate of the drum 110 at one end, and may be extended to the outside of a rear wall of the tub 120 at the other end. When the motor 140 rotates the driving shaft 141, the drum 110 coupled to the driving shaft 141 may be rotated around the driving shaft 141.

A bearing housing 142 may be installed at the rear wall of the tub 120 so as to rotatably support the driving shaft 141. The bearing housing 142 may be formed of an aluminum alloy and may be inserted into the rear wall of the tub 120 when the tub 120 is injection-molded. Bearings 143 are installed between the bearing housing 142 and the driving shaft 141 so that the driving shaft 141 may be smoothly rotated.

The washing machine 1 may do the laundry with hot water. To obtain hot water, heaters 180 may be provided on the bottom of the tub 120 to heat the water (washing water or rinsing water) stored in the tub 120.

Referring to FIG. 3, the heaters 180 may generate heat by supplying a current according to the power consumption. To this end, the heaters 180 may include a main heater 181 and a sub heater 182 that require different currents based on different power consumptions.

In particular, the main heater 181 may be driven by a first main heater current based on a first main heater power consumption, and the sub heater 182 may be driven by a first sub heater current based on a first sub heater power consumption smaller than the first main heater power consumption. The main heater 181 may be provided outside the heaters 180, and the sub heater 182 may be provided inside the main heater 181. A plurality of the heaters 180 may be provided in the tub 120.

The main heater 181 may include a main terminal 181*b* to which the first main heater current is supplied, and a main heating portion 181*a* to generate heat by the supplied first main heater current. The sub heater 182 may include a sub terminal 182*b* to which the first sub heater current is supplied, and a sub heating portion 182*a* to generate heat by the supplied first sub heater current.

Since the main heater 181 and the sub heater 182 are provided with the main terminal 181*b* and the sub terminal 182*b*, respectively, the main heater 181 and the sub heater 182 may be driven together or independently according to the supply of current. In particular, the sub heater 182 may be stopped according to a current value of the motor 140. This will be described later.

Referring back to FIGS. 1 and 2, the washing machine 1 may further include a temperature sensor 183 configured to detect a temperature of the water contained in the tub 120.

The washing machine 1 may include a drain pump 170 arranged in a lower portion of the tub 120 for draining the water out of the washing machine 1 from inside the tub 120, a coupling hose 171 coupling a drain 173 of the tub 120 and the drain pump 170 for allowing the water inside the tub 120 to flow into the drain pump 170, a circulation hose 174 coupling the drain pump 170 and the tub 120 for circulating the water flowing into the drain pump 170 to the tub 120, and a drain hose 172 for guiding the water pumped by the drain pump 170 to the outside of the washing machine 1.

The washing machine 1 may include a front cover 40 provided with an inlet 41 through which laundry (e.g., clothes) is put into the washing space. A door 160 may be coupled to the front cover 40 to open or close the inlet 41.

The door 160 may be provided to correspond to the inlet 41, and may be rotatably provided with respect to the front cover 40. The door 160 may include a door frame 161, a door cover 162, and a door glass 163.

In the embodiments of the disclosure, the door frame 161 may be configured in a substantially annular shape, but may also be configured in a rectangular shape. The door cover 162 and the door glass 163 may be formed of a transparent material so that the inside of the drum 110 can be seen from the outside of the washing machine 1 even when the door 160 closes the inlet 41. The door glass 163 may be disposed to protrude convexly from the door frame 161 toward the inside of the drum 110. When the door 160 is closed through the configuration, the door glass 163 may be inserted into the inlet 41.

A first hinge may be provided around the inlet 41 so that the door 160 can rotate with respect to the front cover 40, and may be coupled to a first hinge coupling portion formed at one side of the door frame 161. A first hook 166 may be provided on the other side of the door frame 161. In response to the first hook 166, the front cover 40 may be provided with a first hook receptacle 42 so that the door 160 may be maintained with the inlet 41 closed.

The door 160 may include an auxiliary laundry inlet and an auxiliary door 164 to open and close the auxiliary laundry inlet so that laundry is put into the washing space even when the door 160 is closed. The auxiliary door 164 may be rotatably mounted to the door cover 162.

In order to put laundry into the washing machine 1 through the auxiliary laundry inlet of the door 160, the laundry passes through the door glass 163. To this end, the door glass 163 may be provided with a glass through hole. Alternatively, an upper portion of the door glass 163 may be recessed so that the door glass 163 is not disposed behind the auxiliary laundry inlet.

In order to connect the auxiliary laundry inlet of the door 160 and the glass through hole of the door glass 163, the door 160 may include a connection guide portion 165. The connection guide portion 165 may be open at both ends, and may be provided in the shape of a tube having a hollow portion.

One end of the connection guide portion 165 may be connected to the auxiliary laundry inlet, and the other end of the connection guide portion 165 may be connected to the glass through hole. In the disclosed embodiment, the connection guide portion 165 may be provided to be inclined downward from the front to the rear. That is, one end of the connection guide portion 165 connected to the auxiliary laundry inlet is at a position higher than the other end. Through such a configuration, it is easy to put laundry into the drum 110 through the auxiliary laundry inlet.

In the disclosed embodiment, the auxiliary door 164 is described as being provided in the door 160, but is not limited thereto. The door 160 may be configured without the auxiliary laundry inlet, the auxiliary door 164, and the connection guide portion.

The washing machine 1 may include a diaphragm 121 disposed between the inlet 41 of the front cover 40 and the opening of the tub 120. The diaphragm 121 may form a passage from the inlet 41 to the opening of the tub 120, and may reduce vibration transmitted to the front cover 40 when the drum 110 rotates. In addition, a portion of the diaphragm 121 may be disposed between the door 160 and the front cover 40 to prevent washing water of the tub 120 from leaking to the outside of the washing machine 1.

In addition, the washing machine 1 may include a water supply device 400 capable of supplying water into the tub 120. The water supply device 400 may be disposed in the housing 130. In addition, the washing machine 1 may include a detergent supply device 500 capable of supplying detergent. The detergent supply device 500 may be disposed in the housing 130.

The washing machine 1 may include a control panel 50 disposed above the front cover 40 to operate the washing machine 1. The control panel 50 may include an inputter for receiving an operation command of the washing machine 1 from a user and a display for displaying operation information of the washing machine 1. In this case, the inputter and the display may be implemented as a single touch screen. Hereinafter, for convenience of description, the control panel 50 may be implemented as a touch screen.

Referring to FIG. 4, the control panel 50 may include a section S in which various kinds of information about the washing machine 1 are displayed. In addition, the control panel 50 may include a power icon P in the center to control on/off of the power of the washing machine 1. When the power icon P is touched by the user, the control panel 50 may receive a command to turn on the power.

Once the command to turn on the power is input as the power icon P is touched, power may be supplied to the washing machine 1. As a result, the control panel 50 may display various selectable objects.

For example, the control panel 50 may include a start icon St1 for starting or stopping washing, a mode icon M1 for selecting a washing mode, an option icon O1 for selecting additional options for washing in accordance with the selected mode, a target temperature setting environment entry icon I1 for entering a target temperature setting environment of water, a target temperature setting icon I11 for setting a target temperature after entering the target temperature setting environment, a rotation speed icon I2 for selecting a rotation speed of the drum 110, a pollution level icon I3 for selecting a pollution level of the laundry, a numerical information display area T1 for displaying various numerical information, and the like.

In addition, the control panel 50 may include an indicator L12 indicating activation, a selection mode indicator L13 indicating a selection mode, a selection rotation speed indicator L14 indicating a selection rotation speed of the drum 110, and a selective pollution level indicator L15 indicating the selected degree of pollution of the laundry.

The washing machine 1 may be supplied with power through a power supply cable. The power supply cable may have a limit current for normal operation, which may be predetermined at the time of manufacture. In addition, an electrical outlet to which the power supply cable is directly connected may also have the limit current.

In addition, the washing machine 1 may be provided with a current breaker. The current breaker may block a power supply path when a current greater than a maximum input current is supplied to the washing machine 1. According to standards established by the National Electrical Manufacturers Association, the washing machine 1 must be designed to operate the current breaker when a current of 46 A or more is supplied for 0.4 msec or longer.

The maximum input current may be determined in consideration of power supply equipment, washing machine design specifications, related laws, etc. The capacity of the heaters 180 and the current of the heaters 180 may be determined in consideration of the maximum input current of the washing machine 1, a peak current of the motor 140, and a current of other power consuming devices.

In order for the washing machine 1 to operate normally, the washing machine 1 is supplied with a current less than the maximum input current. However, when the other power consuming devices including the motor 140, the heaters 180, and the control panel 50 of the washing machine 1 are driven at the same time, an overcurrent greater than the maximum input current may be supplied to the washing machine 1. When the overcurrent is supplied to the washing machine 1, the current supplied to the washing machine 1 is cut off by the current breaker, and the operation of the washing machine 1 may be stopped, thus preventing the overcurrent from being supplied to the washing machine 1.

In order to prevent the overcurrent supply, a prior art has applied a method of reducing the performance of the motor 140 by limiting the current applied to the motor 140 to less than a certain value, and a method of reducing the time that the maximum current is applied to the motor 140 by reducing the load through the drainage.

However, when the current applied to the motor 140 is limited, there is a problem in that the maximum performance of the motor 140 is not utilized, and when the load is reduced through drainage, there is a problem that the washing course is stopped in the middle or the washing performance is deteriorated.

The disclosure may monitor the current applied to the motor 140 in real time, and may prevent the overcurrent from being input to the washing machine 1 by cutting off the current supplied to the sub heater 182 to stop the driving of the sub heater 182 when the current applied to the motor 140 is greater than or equal to a predetermined reference current.

In other words, the disclosure may prevent the overcurrent from being supplied to the washing machine 1 without reducing the limit value of the current applied to the motor 140 or reducing the load through drainage. Therefore, the disclosure may maximize the performance of the motor 140, may prevent the discharge of the detergent due to drainage, and may maintain the driving of the main heater 181, thus making it possible to improve the washing performance.

In addition, the disclosure has an advantage in terms of a washing time and environmental protection because it is not necessary to reload water for washing after draining to reduce the load. In addition, the satisfaction of the user who uses the washing machine 1 can be increased.

Figure 5:
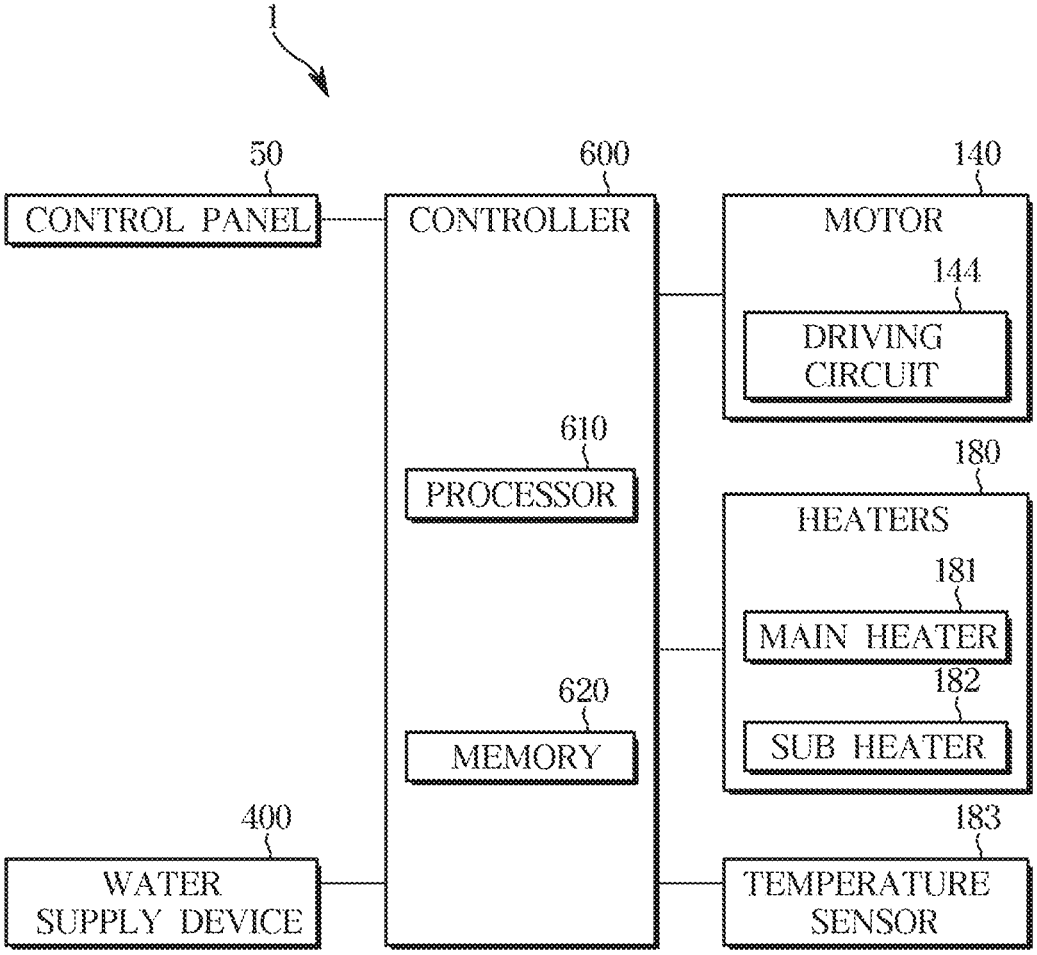
FIG. 5 is a control block diagram illustrating a washing machine according to embodiments of the disclosure.
Figure 6:
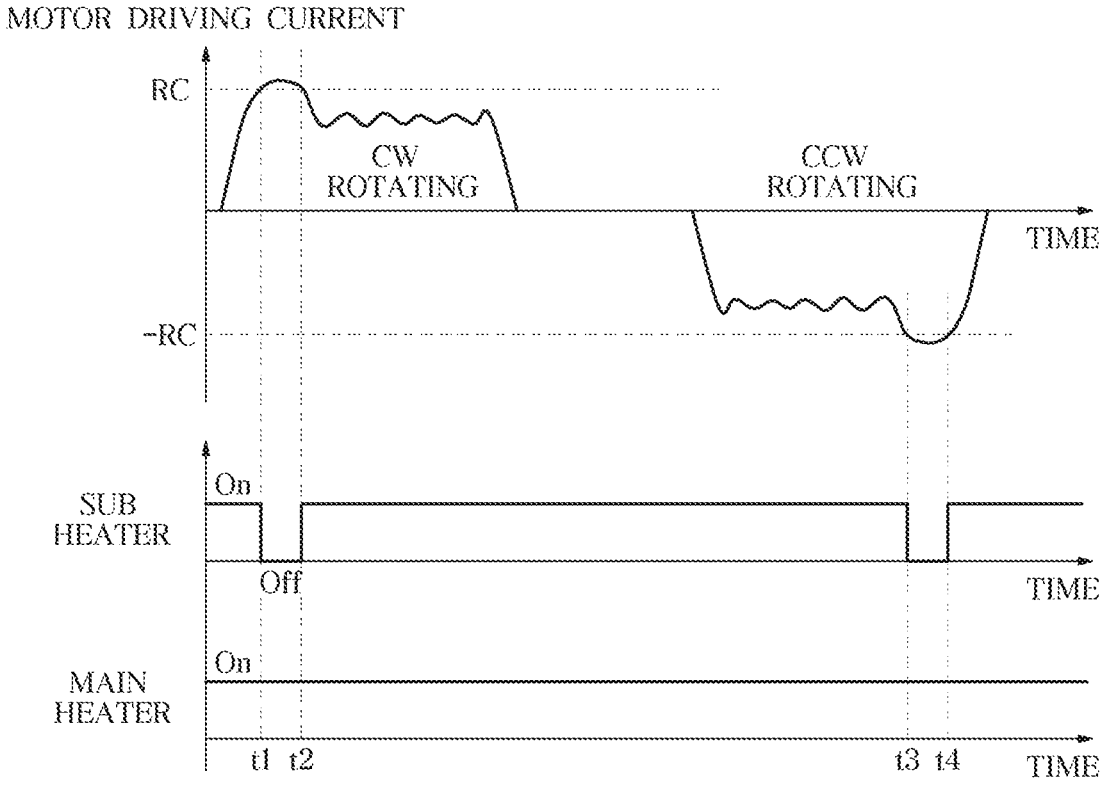
FIG. 6 illustrates a view for describing an operational relationship between a motor and a heater of a washing machine according to embodiments of the disclosure.

Referring to FIGS. 5 and 6, a method of preventing the overcurrent from being input into the washing machine 1 according to the embodiments through driving control of the sub heater 182 is described.

FIG. 5 is a control block diagram illustrating a washing machine according to embodiments of the disclosure.

Referring to FIG. 5, the washing machine 1 may include the control panel 50, the motor 140 for rotating the drum 110, and the heaters 180 including the main heater 181, and the sub heater 182 for heating water stored in the tub 120, the temperature sensor 183 for measuring the temperature of water in the tub 120, the water supply device 400 for supplying water to the tub 120, and a controller 600 for controlling each component of the washing machine 1.

In addition, the motor 140 may include a driving circuit 144 for supplying a driving current. The motor 140 may employ a brushless direct current motor (BLDC motor) or a synchronous motor that easily controls the rotation speed. Alternatively, the motor 140 may employ an inexpensive direct current motor (DC motor) or an induction motor.

The driving circuit 144 may supply the current to the motor 140 in response to the control signal of the controller 600. For example, the driving circuit 144 may include an inverter circuit for supplying the current calculated based on a speed instruction from the controller 600 and the rotation speed of the motor 140 to the motor 140. Furthermore, the driving circuit 144 may include a power switching circuit to allow or block the current from being applied to the motor 140 in response to an on/off command from the controller 600. The controller 600 may adjust the rotation speed of the motor 140 by adjusting the magnitude of the current applied to the motor 140.

In addition, the driving circuit 144 may detect the current applied to the motor 140. The driving circuit 144 may detect the current applied to the motor 140 in real time. In addition, the driving circuit 144 may convert the measured current value of the motor 140 into an absolute value and transmit it to the controller 600.

The temperature sensor 183 may be installed inside the tub 120 for outputting an electrical signal corresponding to the temperature of the water contained in the tub 120 to the controller 600. The temperature sensor 183 may include a thermistor whose electrical resistance value changes according to the temperature.

The heaters 180 may include an electrical resistor heated by the power, and a switching circuit for controlling the power to be supplied to the electrical resistor. The heaters 180 may heat the water contained in the tub 120 according to a control signal of the controller 600.

Hereinafter, a method of controlling driving of the heaters 180 based on operations of the controller 600 will be described.

The controller 600 may include a memory 620 for memorizing/storing a program and data for controlling the operation of the washing machine 1, and a processor 610 for creating control signals to control the operation of the washing machine 1 according to the program and data memorized/stored in the memory 620. The processor 610 and the memory 620 may be implemented in separate chips or in a single chip. In addition, the controller 600 may include a plurality of processors and a plurality of memories.

The memory 620 may include volatile memories, such as Static Random Access Memories (S-RAMs), Dynamic RAMs (D-RAMs), or the like for temporarily storing data, and non-volatile memories, such as Read Only Memories (ROMs), Erasable Programmable ROMs (EPROMs), Electrically Erasable Programmable ROMs (EEPROMs), flash memories or the like for storing data for a long period of time.

The processor 610 may include logic circuits and operation circuits to process data under a program provided from the memory 620 and create a control signal according to the result of the process.

When the user operates the control panel 50 to input a washing command and a target temperature in a specific mode, the washing machine 1 may perform washing according to the set mode. Accordingly, the controller 600 may drive the heaters 180 such that the washing water in the tub 120 reaches a first target temperature according to a first mode. The controller 600 may supply a current corresponding to the first target temperature of the first mode to the heaters 180, and the heaters 180 may heat the water in the tub 120 according to the supplied current.

The controller 600 may drive the heaters 180 so that the temperature of the water in the tub 120 reaches the target temperature, and may control the driving of the sub heater 182 based on the current value of the motor 140.

Figure 7:
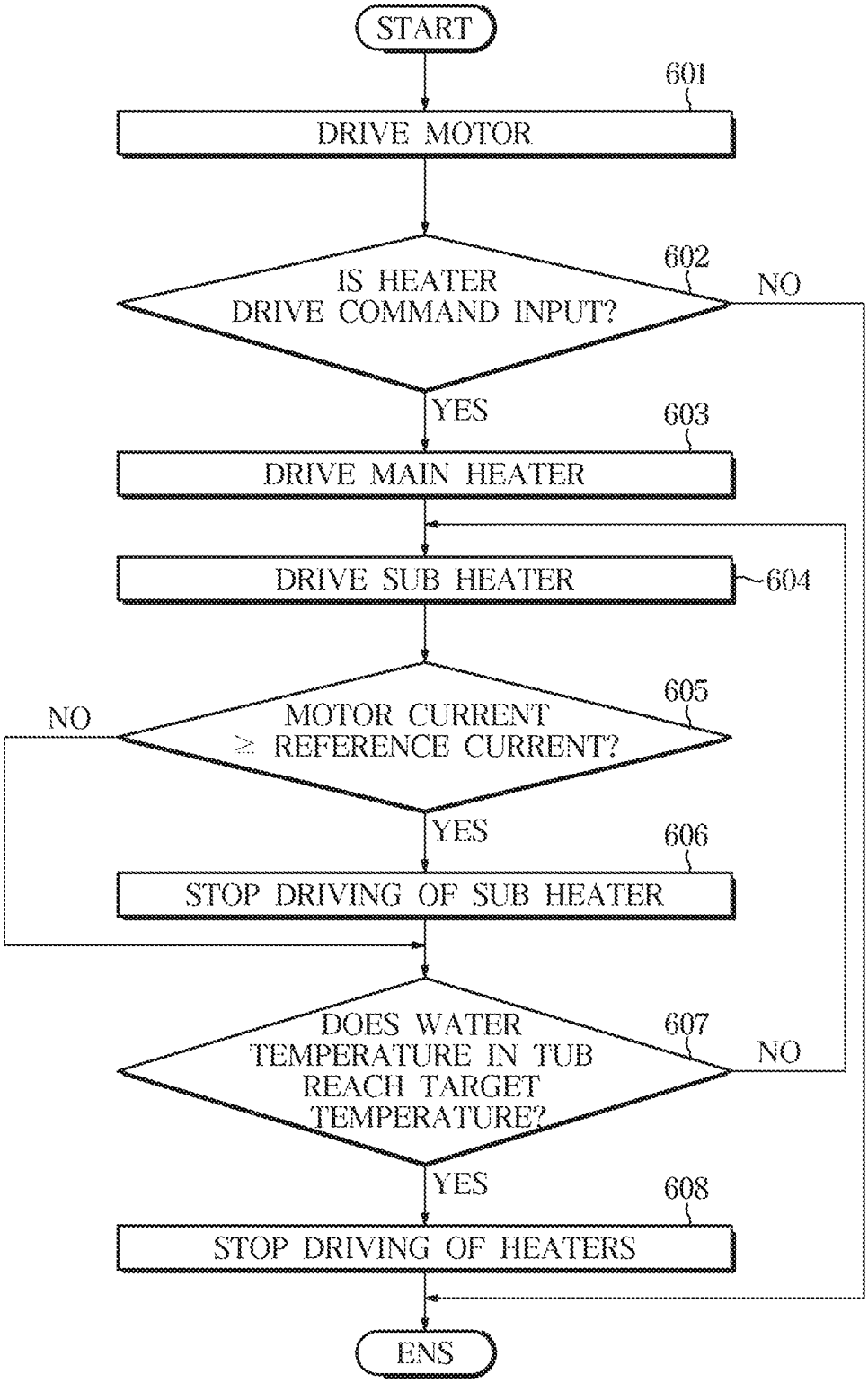
FIG. 7 is a flowchart illustrating a method of controlling a washing machine according to an embodiment of the disclosure.

FIG. 6 illustrates a view for describing an operational relationship between a motor and a heater of a washing machine according to embodiments of the disclosure, and FIG. 7 is a flowchart illustrating a method of controlling a washing machine according to an embodiment of the disclosure.

Referring to FIGS. 6 and 7, when the washing command of the specific mode is input through the control panel 50, the controller 600 may control the driving circuit 144 to apply the current to the motor 140 and drive the motor 140 (601).

Until the motor 140 starts to rotate and reaches a target rotation speed (RPM, revolutions per minute), the current applied to the motor 140 increases to reach a current limit value or the peak current. When the motor 140 is initially driven, the current applied to the motor 140 may rapidly increase to reach the peak current. When the rotation speed of the motor 140 reaches the target rotation speed, the current of the motor 140 may decrease to maintain a value within a certain range.

Even if a current smaller than the peak current is applied to the motor 140, the rotation speed of the motor 140 may be maintained at the target rotation speed due to inertia. When the rotation speed of the motor 140 becomes smaller than the target rotation speed due to a frictional force or the like, the controller 600 may control the driving circuit 144 to increase the current applied to the motor 140 again. In other words, the magnitude of the current applied to the motor 140 may be repeated to increase or decrease, and a larger current is applied to the motor 140 when the rotation speed of the motor 140 increases than when the rotation speed of the motor 140 is maintained constant.

Meanwhile, the target rotation speed of the motor 140 may be predetermined in the design process of the washing machine 1. In addition, the target rotation speed of the motor 140 may be determined differently for various washing modes. The higher the target rotation speed of the motor 140 is set, the longer the peak current is applied to the motor 140.

In addition, the controller 600 may control the motor 140 to repeat alternate rotation of the drum 110 clockwise (CW) and counterclockwise (CCW). That is, the controller 600 may apply a positive (+) current to the motor 140 to rotate the drum 110 in a clockwise direction, and apply a negative (−) current to the motor 140 to rotate the drum 110 in a counterclockwise direction.

On the other hand, when the command input through the control panel 50 includes a drive command of the heaters 180, the controller 600 may drive the heaters 180 (602). In FIG. 7, the main heater 181 and the sub heater 182 are sequentially driven (603 and 604), but the controller 600 may simultaneously drive the main heater 181 and the sub heater 182.

At this time, the controller 600 may apply the current required for each of the motor 140, the main heater 181, and the sub heater 182. In addition, the controller 600 may also apply necessary currents to the other power consuming devices such as the control panel 50.

However, when the motor 140, the main heater 181, the sub heater 182, and the other power consumption devices are driven at the same time, the overcurrent greater than the maximum input current may be supplied to the washing machine 1. That is, the sum of the current applied to the motor 140, the current applied to the heaters 180, and the current applied to the other power consuming devices may be greater than or equal to the maximum input current.

As described above, when the overcurrent of the maximum input current or more is supplied to the washing machine 1, the current supplied to the washing machine 1 may be cut off by the current breaker, and the operation of the washing machine 1 may be stopped. It is necessary to prevent the overcurrent from being supplied.

Particularly, when a current greater than a reference current RC is applied to the motor 140 while the rotation speed of the motor 140 is increased, a situation may occur in which the overcurrent greater than or equal to the maximum input current is supplied to the washing machine 1. When the negative current is applied to the motor 140, the overcurrent supply may occur when a current less than or equal to a reference current −RC is applied. The absolute values of the reference currents RC and −RC are the same, and the driving circuit 144 may return the current value of the motor 140 as the absolute value.

The reference currents RC and −RC are smaller than the peak current values that can be applied to the motor 140 and are values for determining a section in which the driving of the sub heater 182 is stopped. Referring to FIG. 6, it can be seen that the driving of the sub heater 182 is stopped in sections t1 to t2 in which the current value of the motor 140 exceeds the reference current RC, and sections t3 to t4 in which the current value of the motor 140 is less than the reference current −RC.

The reference current may be determined according to the design specifications of the motor 140. For example, when the peak current that can be applied to the motor 140 is 12 A, the reference current RC may be determined to be 10.8 A, which is 10% smaller than the peak current.

On the other hand, since the power consumed by the other power consuming devices such as the control panel 50 is not large and the current fluctuation is small, the possibility of occurrence of the overcurrent input by the other power consuming devices is low.

Accordingly, the controller 600 may determine whether the current exceeding the reference current RC is applied to the motor 140 based on the current value (absolute value) of the motor 140 obtained by the driving circuit 144 (605), and may stop the driving of the sub heater 182 by cutting off the current applied to the sub heater 182 at the time points t1 and t3 when the current exceeding the reference current RC is applied to the motor 140 (606).

In addition, the controller 600 may drive the sub heater 182 again at time points t2 and t4 when the current value applied to the motor 140 becomes smaller than the reference current RC. At this time, the controller 600 may determine whether the temperature of the water in the tub 120 has reached the target temperature based on the temperature of the water in the tub 120 obtained by the temperature sensor 183, and may determine whether to re-drive the sub heater 182 (607).

In addition, when the temperature of the water in the tub 120 reaches the target temperature, the controller 600 may stop the driving of the main heater 181 by cutting off the current applied to the main heater 181 (608).

Meanwhile, when the peak current is applied to the motor 140, the driving of the sub heater 182 may be stopped, but by stopping the driving of the sub heater 182 based on the reference current smaller than the peak current, the risk of damage to the washing machine 1 can be reduced and safety can be ensured.

As such, the washing machine 1 according to the embodiments may monitor the current applied to the motor 140 in real time, and may stop the driving of the sub heater 182 by cutting off the current supplied to the sub heater 182 when the current applied to the motor 140 is greater than or equal to the predetermined reference current, thereby preventing the overcurrent from being input to the washing machine 1.

In addition, the washing machine 1 may prevent the overcurrent from being supplied to the washing machine 1 without having to lower the limit value of the current applied to the motor 140 or reduce the load through drainage. Therefore, it is possible to make the most of the performance of the motor 140, to prevent the discharge of the detergent due to drainage, and to maintain the driving of the main heater 181, so that the washing performance can be improved.

According to the washing machine and the method of controlling the washing machine of embodiments, when the motor and the heaters are driven at the same time, it is possible to prevent the overcurrent from flowing into the washing machine by controlling the driving of the sub heater according to the current value of the motor.

In addition, when the motor and the heaters are driven at the same time, since the driving of the sub heater is controlled according to the current value of the motor while maintaining the driving of the motor and the main heater, there is no need to lower the limit value of the motor, and no drainage for load reduction is necessary. As a result, the washing performance can be improved.

Further, since there is no need for rewatering for drainage and washing to reduce the load, there is an advantage in terms of the washing time and environmental protection, and it is possible to increase the satisfaction of the user who uses the washing machine.

Meanwhile, the disclosed embodiments may be implemented in the form of a recording medium storing instructions that are executable by a computer. The instructions may be stored in the form of a program code, and when executed by a processor, the instructions may generate a program module to perform operations of the disclosed embodiments. The recording medium may be implemented non-transitory as a computer-readable recording medium.

The non-transitory computer-readable recording medium may include all kinds of recording media storing commands that can be interpreted by a computer. For example, the non-transitory computer-readable recording medium may be, for example, ROM, RAM, a magnetic tape, a magnetic disc, flash memory, an optical data storage device, etc.

Embodiments of the disclosure have thus far been described with reference to the accompanying drawings. It will be obvious to those of ordinary skill in the art that the disclosure may be practiced in other forms than the embodiments as described above without changing the technical idea or essential features of the disclosure. The above embodiments are only by way of example, and should not be interpreted in a limited sense.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a tub configured to store water;

a drum configured to be rotatable in the tub;

a motor configured to rotate the drum;

heaters configured to heat the water stored in the tub, the heaters including a main heater and a sub heater; and a controller configured to:

control the heaters to stop driving of the sub heater when a current value of the motor exceeds a predetermined reference current value during driving of the motor and the heaters; and control the heaters to drive the sub heater again in response to the current value of the motor becoming smaller than the predetermined reference current value after the driving of the sub heater is stopped.

2. The washing machine according to claim 1, wherein a power consumption of the main heater is larger than a power consumption of the sub heater.

3. The washing machine according to claim 1, wherein the controller is configured to drive the sub heater again in response to a temperature of the water in the tub being lower than a target temperature.

4. The washing machine according to claim 1, further comprising a control panel configured to provide a washing mode selection menu.

5. The washing machine according to claim 4, wherein the controller is configured to control the driving of the motor according to a washing mode input through the control panel.

6. The washing machine according to claim 4, wherein the controller is configured to control the driving of the main heater according to a washing mode input through the control panel.

7. The washing machine according to claim 4, wherein the controller is configured to control the driving of the sub heater according to a washing mode input through the control panel.

8. The washing machine according to claim 1, wherein the controller is configured to independently control the main heater and the sub heater.

9. The washing machine according to claim 1, wherein the controller is configured to obtain the current value of the motor in real time.

10. A method of controlling a washing machine comprising:

driving, by a controller, a motor configured to rotate a drum provided in a tub;

driving, by the controller, heaters including a main heater and a sub heater so that a temperature of water stored in the tub reaches a target temperature;

obtaining, by the controller, a current value of the motor;

controlling, by the controller, the heaters to stop the driving of the sub heater when the current value of the motor exceeds a predetermined reference current value during the driving of the motor and the heaters; and controlling, by the controller, the heaters to drive the sub heater again in response to the current value of the motor becoming smaller than the predetermined reference current value after the driving of the sub heater is stopped.

11. The method according to claim 10, wherein a power consumption of the main heater is larger than a power consumption of the sub heater.

12. The method according to claim 10, wherein the controlling of the heaters further comprises driving the sub heater again in response to the temperature of the water in the tub being lower than the target temperature.

13. The method according to claim 10, wherein the controlling of the heaters further comprises independently controlling the main heater and the sub heater.

14. The method according to claim 13, wherein the obtaining of the current value of the motor comprises obtaining the current value of the motor in real time.

15. The method according to claim 10, further comprising controlling the driving of the motor according to a washing mode input.

16. The method according to claim 10, further comprising controlling the driving of the main heater according to a washing mode input.

17. The method according to claim 10, further comprising controlling the driving of the sub heater according to a washing mode input.

* * * * *